US007568674B2

(12) United States Patent
Polster

(10) Patent No.: US 7,568,674 B2
(45) Date of Patent: Aug. 4, 2009

(54) DEVICE TO READ IN BED OR WHEN RECLINING

(76) Inventor: John Christopher Polster, 1230 Gerry St., Woodstock, IL (US) 60098

( * ) Notice: Subject to any disclaimer, the term of this patent is extended or adjusted under 35 U.S.C. 154(b) by 168 days.

(21) Appl. No.: 11/604,021

(22) Filed: Feb. 16, 2007

(65) Prior Publication Data

US 2008/0197261 A1 Aug. 21, 2008

(51) Int. Cl.
*A47B 23/00* (2006.01)

(52) U.S. Cl. ..... 248/446; 248/441.1; 248/445

(58) Field of Classification Search ..... 248/444.1, 248/441.1

See application file for complete search history.

(56) References Cited

U.S. PATENT DOCUMENTS 4,685,647 A * 8/1987 Calhoun ..... 248/444.1
5,607,135 A * 3/1997 Yamada ..... 248/456

* cited by examiner

*Primary Examiner*—J. Allen Shriver, II
*Assistant Examiner*—Erin Smith

(57) ABSTRACT

In accordance with the aspects of the present invention, an improved book holder for reading in bed is disclosed. The present invention includes a base panel, back panel, central slotted unit and moveable plexiglass plate rectangular in shape. Movement of the plexiglass plate to the different slotted positions allow the invention to accommodate books of any size. The user of the invention reads through the plexiglass, including the top edge thereof, to see the printed material on the open page of the book. The plate is not so large as to cover the entire printed page(s), reducing the size and weight to the invention and making it highly portable and storable.

4 Claims, 1 Drawing Sheet

DEVICE TO READ IN BED OR WHEN RECLINING

RELATED APPLICATIONS

This non-provisional application claims priority to my U.S. Provisional Application No. 60/739,095 filed Nov. 22, 2005, the benefit of which is hereby claimed under 35 U.S.C. 119(e).

FIELD OF THE INVENTION

The present invention relates to book stands, and more particularly to those used when reading in bed or reclining.

BACKGROUND OF THE INVENTION

This inventor spends much time reading in bed, and suffers from muscle fatigue in the arms and hands, due to a medical condition, and cannot hold a book upright for extended periods. In the late 1980s he created a device which rests on the abdomen of the reader, allowing her arms and hands to be rested, and does not require installation of the device into the wall, ceiling or bed.

Book stands are currently available in a variety of shapes and sizes. Current stands have a number of drawbacks, particularly those designed for reading in bed. These must typically be affixed to the bed or a nearby wall, and involve metal "arms" which hover over the reader. These suffer from the difficulty of installation, are bulky and unsightly, and occupy excessive space, are difficult to adjust, and cannot support a variety of sizes of books or reading materials, especially larger books.

The user of the present invention rests the invention on her chest or abdomen, inserts the open book between the plexiglass plate and the back panel described herein below, and reads "through" the plexiglass, including the top edge thereof, to see the printed material. The plate is not so large as to cover the entire printed page(s), reducing the size and weight of the invention and making it highly portable and storable.

SUMMARY OF THE INVENTION

In accordance with the aspects of the present invention, an improved book stand, portable and not affixed to any other structure, is disclosed. The present invention includes a flat base board which rests horizontally, a vertical back board attached thereto which supports the back of the upstanding book, a slotted base unit, which supports the bottom of the book and which contains slots, into any one of which slots rests the plexiglass member which supports the front of the book or other reading material. The plexiglass member is a low shield which can be read "through" the bottom edge of which is placed into one of the slots so that the plexiglass is held upright. The device can be made of wood, plastic, metal or other rigid material, except for the shield, which can be made of glass, plastic or other clear material.

BRIEF DESCRIPTION OF THE DRAWINGS

The foregoing aspects an many of the attendant advantages of this invention will become more readily appreciated as the same become better understood by reference to the following detailed description, when taken in conjunction with the accompanying drawing and FIGURES, wherein.

DETAILED DESCRIPTION OF THE PREFERRED EMBODIMENT

Figure 1:
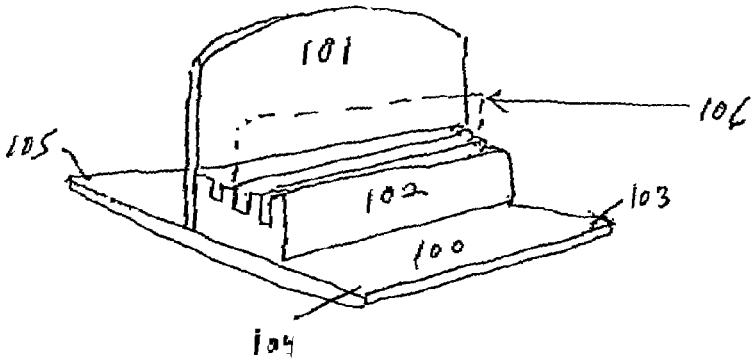
FIG. 1 is a perspective view of the invention as it may appear to a reader who rests the invention on his abdomen while reclining in bed. The dotted line (in ALL FIGURES) depicts the low plexiglass shield which reduces the bulk of the invention because of its low profile. The corners of the shield, while appearing square, are actually slightly rounded off for the comfort of the reader when handling the same.
Figure 2:
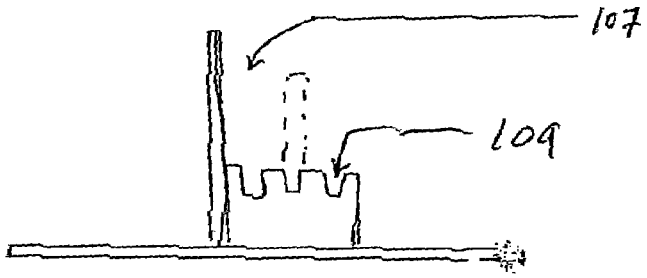
FIG. 2 is a side plan view of the invention, showing the slots in which the clear shield rests so that the invention can accommodate any size book.
Figure 3:
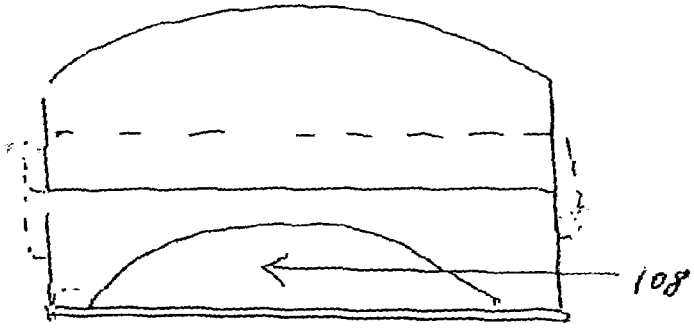
FIG. 3 is a frontal plan view, showing the hollowed arch in the underside of the base unit, which hollow area lightens the weight of the invention and makes it easier to lift and handle.

The present invention is an improvement to a book holder or strand used for reading in bed or otherwise in a reclining position. By way of overview and with reference to FIGS. 1-3, one presently preferred embodiment of the present invention includes the following attached pieces: the base panel 100 and the back panel 101. The base panel is rounded at the corners, 103, 104, 105 for the comfort of the user, since those are in contact with user's abdomen.

The Central Unit 102 is a solid piece of wood or plastic, or a hollowed piece of metal in one presently preferred embodiment, containing slots 109, into which the bottom edge of a plexiglass member 106 is inserted. The transparent rectangular piece may be inserted into any one of the slots in the base unit, accommodating a book or magazine of any size. The open book rests upon the base unit between the transparent rectangular piece and the back panel in the area of 107. The reader then reads "through" the transparent piece, including its top edge, which does not materially obstruct the user's view of the text.

The central unit is hollowed out in an arched or open "tunnel" where the central unit is connected to the base panel as depicted in 108. This tunnel area runs from the front to the back of the base unit, reducing the weight of the invention.

The clear shield is not attached to the central unit, so that it can be used to adjust the invention to a size of different books or other reading materials. Instead the clear shield simply rest in one of the slots such as 109.

The invention claimed is:

1. A book holder comprising a base panel which lies flat upon the user's abdomen, a back panel attached perpendicular to said base panel, a central unit attached to the base and back panels at the intersection thereof wherein said central unit is slotted at the top and said central unit and back panel are hollowed out in an arch or other pattern in the bottom to form a passageway, wherein a hand can be inserted into said passageway to lift the device onto the abdomen of the user a plexiglass or other clear transparent shield resting in a slot in the central unit whereby a front of a reading material is restrained as said reading material leans against the back panel and rests upon the top of the central unit.

2. A central unit, as constructed in claim 1, wherein slots at various distances from the back panel are created to receive the plexiglass or other clear shield.

3. A central unit as constructed in claim 2, wherein the underside of the central unit is hollowed out where it meets the base panel.

4. A base panel as constructed in claim 1, wherein the corners of the base unit are rounded off so that sharp corners do not come into contract with the abdomen of the user of the invention.

* * * * *